United States Patent [19]

Young et al.

[11] Patent Number: 4,641,472

[45] Date of Patent: Feb. 10, 1987

[54] FASTENER FOR SECURING ROOFING MATERIAL TO CEMENTITIOUS ROOF DECKS HAVING REMOVABLE TAB

[75] Inventors: Kenneth E. Young, Greenville, S.C.; Hubert T. Dudley, Chelmsford; Robert T. Frohlich, Bedford, both of Mass.

[73] Assignee: W. R. Grace & Co., Cambridge, Mass.

[21] Appl. No.: 882,709

[22] Filed: Mar. 2, 1978

[51] Int. Cl.[4] ..... F16B 15/02; F16B 15/04

[52] U.S. Cl. ..... 52/361; 52/366; 52/411; 52/515; 411/448; 411/477; 411/531; 411/545

[58] Field of Search ..... 85/1 JP, 11, 23, 26, 85/28, 29, 50 R, 63; 52/361, 362, 363, 410, 411, 412, 413, 414, 516, 544, 748, 515, 366; 156/66, 92, 295, 71, 91, 252; 428/133, 139, 468

[56] References Cited

U.S. PATENT DOCUMENTS

| | | | |
|---|---|---|---|
| 63,737 | 4/1867 | McGill | 85/13 |
| 308,837 | 12/1884 | Frost | 85/13 |
| 578,151 | 3/1897 | Knudsen | 85/13 |
| 667,814 | 2/1901 | Wyland | 85/11 |
| 795,553 | 7/1905 | Sherman | 85/50 R X |
| 855,318 | 5/1907 | Kindig | 85/13 |
| 921,767 | 5/1909 | White | 52/444 |
| 1,025,799 | 5/1912 | Fulenwider | 85/13 |
| 1,102,871 | 7/1914 | Carroll | 85/28 |
| 1,143,091 | 6/1915 | Stimpson | 85/50 R |
| 1,231,887 | 7/1917 | Herman | 85/13 |
| 1,264,504 | 4/1918 | Gude | 52/366 |
| 1,278,270 | 9/1918 | Wilber | 428/139 |
| 1,670,890 | 5/1928 | Illmer | 85/50 R |
| 1,700,561 | 1/1928 | Commin et al. | 156/92 |
| 2,102,901 | 12/1937 | Laursen | 85/50 R |
| 2,157,374 | 5/1939 | Wells | 52/363 |
| 2,193,122 | 3/1940 | Crabbs | 85/50 R X |
| 2,498,627 | 2/1950 | Hallock | 85/11 |
| 2,744,591 | 5/1956 | Simpson | 85/1 JP |
| 2,745,308 | 5/1956 | Gisondi | 85/13 |
| 3,135,069 | 6/1964 | Schuller et al. | 52/411 X |
| 3,240,101 | 3/1966 | Hallock | 85/23 |
| 3,246,439 | 4/1966 | Foster et al. | 85/28 |
| 3,466,967 | 9/1969 | Hallock | 85/11 |
| 3,710,672 | 1/1973 | Hallock | 85/11 |
| 3,812,817 | 5/1974 | Hallock | 85/11 X |
| 3,878,756 | 4/1975 | Hallock | 85/23 |
| 3,882,755 | 5/1975 | Enstrom | 85/11 |
| 3,905,549 | 9/1975 | Walker | 85/26 |
| 4,031,802 | 6/1977 | Hallock | 85/11 |
| 4,043,246 | 8/1977 | Wright | 85/11 |

FOREIGN PATENT DOCUMENTS

| | | | |
|---|---|---|---|
| 682956 | 10/1939 | Fed. Rep. of Germany | 85/28 |
| 920221 | 11/1954 | Fed. Rep. of Germany . | |
| 2,636,627 | 2/1978 | Fed. Rep. of Germany | 52/444 |
| 935042 | 1/1948 | France | 85/50 R |
| 7415863 | 6/1976 | Netherlands | 85/50 R |
| 957852 | 5/1964 | United Kingdom . | |

OTHER PUBLICATIONS

"Inspec Data", E.S. Products, Inc., 07500, May, 1976.

*Primary Examiner*—Thomas J. Holko
*Attorney, Agent, or Firm*—William L. Baker

[57] ABSTRACT

A fastener for securing built-up roofing membranes used to waterproof cementitious roof decks combines the conventional nail used for this purpose having a head and a shank portion designed to resist withdrawal of the fastener from the deck, with a non-integral tab penetrated by the shank of the nail and of larger diameter than the nail head, the tab having a design which allows the fluid asphalt conventionally poured over the nail during construction of the roofing membrane to bond the portion of the membrane beneath the tab and thereby increase the wind uplift resistance of the covering material. Removability of the tab allows its detachment in applications where increased uplift resistance is unnecessary.

8 Claims, 13 Drawing Figures

FIG. 1
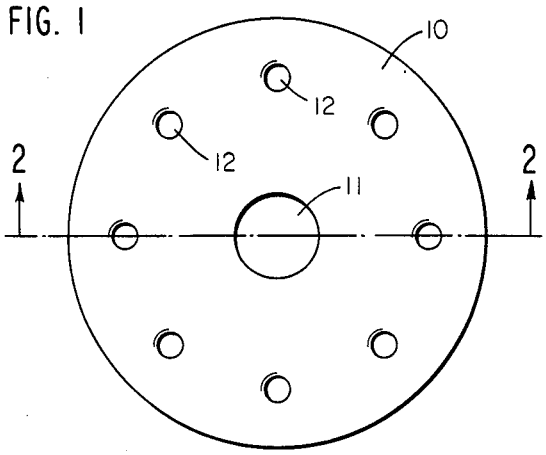
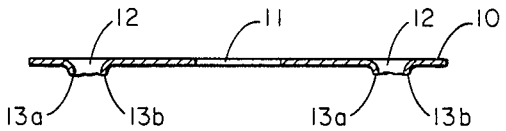
FIG. 2
FIG. 3
(PRIOR ART)
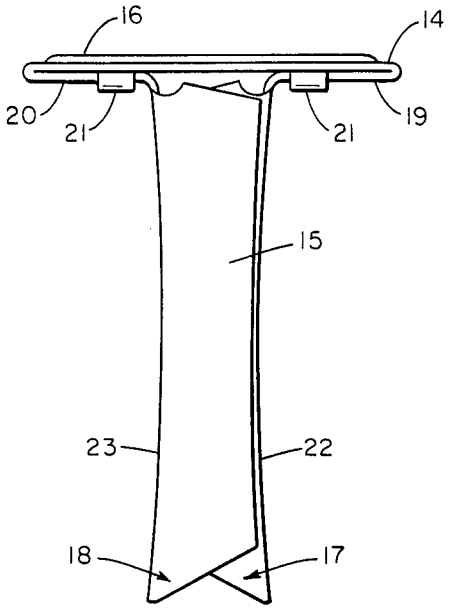
FIG. 4
(PRIOR ART)
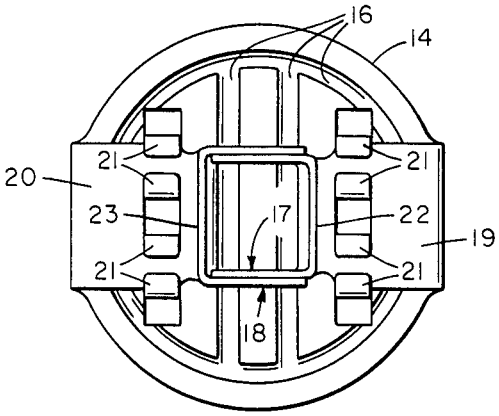
FIG. 5
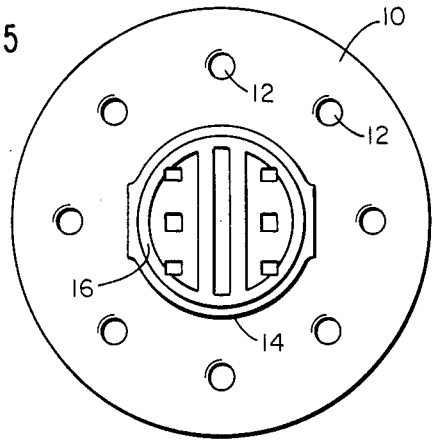
FIG. 6
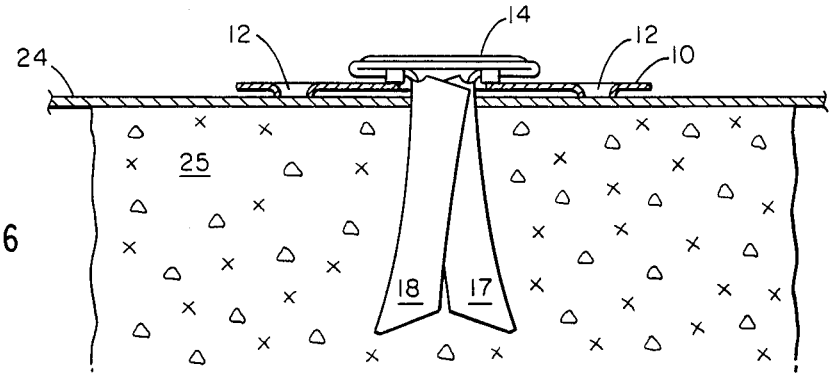

FIG. 7
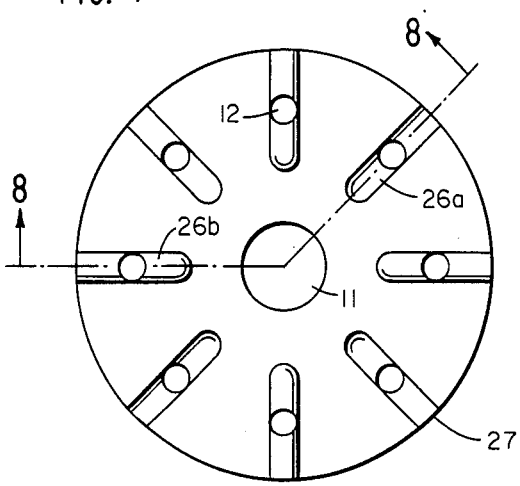
FIG. 9
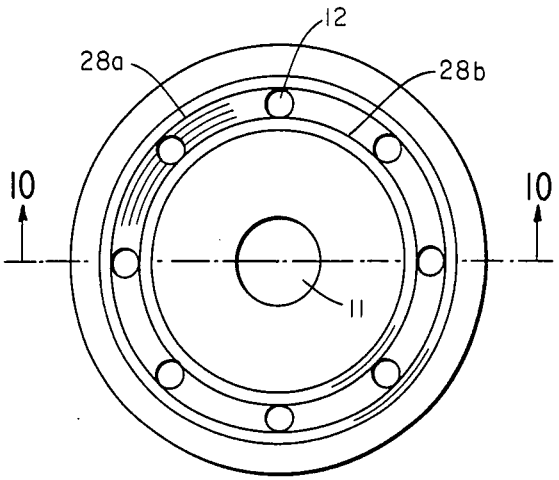
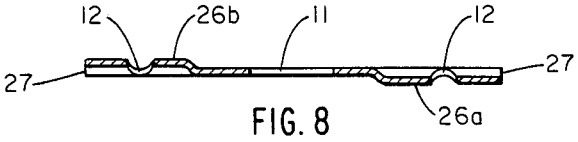
FIG. 8
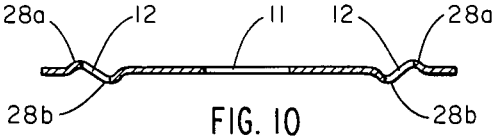
FIG. 10
FIG. 11
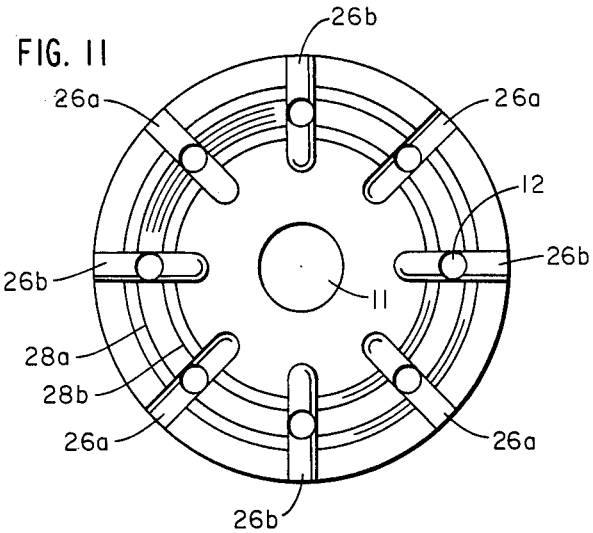
FIG. 12
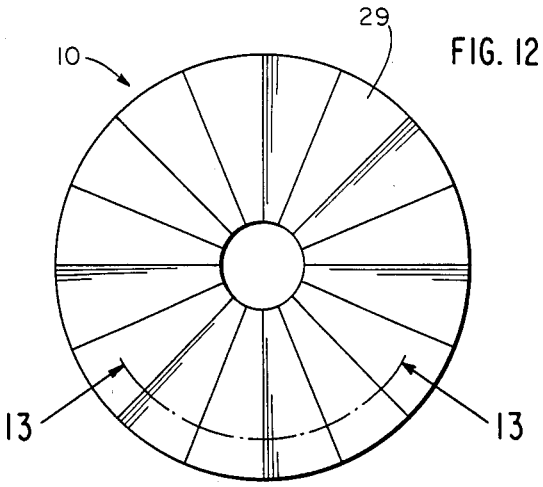
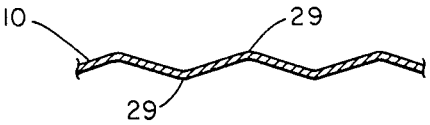
FIG. 13

FASTENER FOR SECURING ROOFING MATERIAL TO CEMENTITIOUS ROOF DECKS HAVING REMOVABLE TAB

BACKGROUND OF THE INVENTION

This invention relates to fasteners of the type utilized to secure coverings to cementitious substrates. More particularly, this invention concerns fasteners of the type used to anchor built-up waterproofing membranes to cementitious roof decks, which fasteners improve the wind uplift resistance of the built-up roofing membrane.

Conventional "flat" roofs or roof decks often utilize a layer of hydratable cementitious material such as Portland cement type concrete to impart structural strength and rigidity and/or thermal insulating properties in the case of lightweight aggregate-containing concretes which hydrate into relatively low-density masses. Typically a waterproof covering layer is applied to the uppermost surface of the cementitious layer and such covering layer must be secured in some fashion. Most commonly the waterproof covering is in the form of several plies of sheet material bonded together by hot asphalt, each ply being applied or "built-up" on the job site and adhered together by intermittent moppings of hot fluid asphalt. The first ply, termed the "base ply", is either adhered over its entire surface to the surface of the cementitious layer using e.g. hot asphalt, or is secured only at spaced intervals using "spot" applications of hot asphalt or mechanical fasteners forced through the base ply and into the soft concrete before it has fully hydrated into a hard rigid mass. The remaining plies of the built-up roofing are then secured to the base ply over their entire surfaces by hot moppings of fluid asphalts.

The mechanical fasteners or "nails" used to secure the base ply in various "spots" generally have a penetrating shank designed to resist withdrawal from the concrete layer, and a flat head which is wider in diameter than the shank thereby acting as a washer to hold the built roofing. The shank is typically made resistant to withdrawal from the concrete by causing the shank to expand in diameter near its penetrating end either as it enters the soft concrete or soon thereafter. In the fasteners for example of U.S. Pat. Nos. 3,466,967; 3,710,672 and 4,031,802 to Hallock, the shank portion of the fastener comprises a slit cone or a pair of hinged legs and is caused to expand as the fastener is inserted into the soft cementitious mass. The shank portions of these fasteners moreover define a hollow space which receives a portion of the soft cement mixture as the fastener is driven thereby increasing the resistance of the fastener to withdrawal particularly after the cement has hardened.

The nail in particular of the type shown in U.S. Pat. Nos. 3,710,672 and 4,031,802 to Hallock has proven in practice to be especially effective for locking built-up roofing to lightweight low density expanded vermiculite or perlite containing concretes. The nail is economically formed as a one piece integral product from sheet metal stock and has a high resistance to withdrawal from the concrete layer. Difficulity has been experienced however in passing certain stringent wind uplift resistance requirements with built-up roofings fastened to such concrete layers using nails of this type. A need exists therefore for a practical manner of enhancing the wind uplift resistance of roofings secured with this and other similar types of fasteners.

SUMMARY OF THE INVENTION

In laboratory experiments designed to test the resistance of built-up roofing membranes to being uplifted by wind, essentially a vacuum is created above the built-up roofing stimulating the effect of a high wind upon an installed roof atop a building. In investigating the cause of failure of built-up roofings to remain attached to insulating concretes using the aforementioned fasteners of U.S. Pat. No. 3,710,672, in particular, it was found that the cause of failure was due to tearing loose of the base ply around the perimeter of the nail head as opposed to withdrawal of the shank from the concrete layer or delamination of the plies in the built-up roofing as might first be theorized. Moreover it was discovered that simply increasing the number of nails used to attach the base or first ply of the roofing by a practical proportion did not allow the roof to pass the more stringent requirements for wind uplift resistance. Further investigations led to the finding that this tearing loose could be avoided by providing the nail with a flat tab having a central opening penetrated by the shank of the nail and wider in diameter than the head of the nail, the tab further having a design which allows the hot fluid asphalt subsequently poured over the nail to bond the portion of the base ply beneath the tab, effectively reinforcing the weakened portions of the base ply beneath the tab and nail head against tearing loose during uplifting by a vacuum above the roofing simulating the effect of a high wind. According to the present invention, this desirable bonding-reinforcement of the weakened underlaying base ply portions is accomplished by providing the tab with a number of openings into which the asphalt can flow and/or undulations in its surface which create spaces between the tab and the underlying base ply for receiving the asphalt. In preferred embodiments of the invention, the tab has both openings and surface undulations, for example lugs, stand-offs or embossments on its lower surface, or channels communicating with the openings in the tab and/or the edges of the tab. In these preferred embodiments, the portion of the base ply beneath the tab becomes bonded both to the upper plies of roofing by way of the openings, and also to the lower surface of the tab for optimum reinforcement. The tab is preferably made easily removable from the shank of the nail to avoid its added expense in applications where increased uplift resistance is unnecessary.

BRIEF DESCRIPTION OF THE DRAWINGS

FIG. 1 is a top plan view of a tab for use in conjunction with a conventional fastener or nail of the type shown in FIGS. 3 and 4;

FIG. 2 is a cross sectional view along the line 2—2 of FIG. 1;

FIG. 3 is a side view of a preferred prior art nail for use with the tab of FIG. 1;

FIG. 4 is a view looking upwards from the bottom of the nail of FIG. 3;

FIG. 5 is a top plan view of the nail of FIG. 3 inserted through the central hole of the tab of FIG. 1;

FIG. 6 is a side sectional view of the nail-tab combination shown in FIG. 5 after such has been driven through a base ply positioned upon a slab of lightweight insulating concrete;

FIG. 7 is a top plan view of an alternative tab for use according to the invention.

FIG. 8 is a sectional view taken along the line 8—8 of FIG. 7;

FIG. 9 is a top plan view of another alternative construction of a tab for use according to the invention;

FIG. 10 is a sectional view along the line 10—10 of FIG. 9;

FIG. 11 is a top plan view of yet another alternative tab construction for use according to the invention.

FIG. 12 is a top plan view of still another tab construction; and

FIG. 13 is a sectional view along the line 13—13 of FIG. 12.

DETAILED DESCRIPTION

The invention is best described in detail with reference to the accompanying drawings. In FIG. 1, circular tab 10 has a thickness of 0.012 inch (0.039 cm.) and a diameter of 2.75 inches (6.99 cm.). Tab 10 has a central circular opening 11 and the diameter of which measures 0.56 inch (1.43 cm.). The tab 10 can be fashioned from any rigid material, e.g. metal or plastic, but is preferably galvanized steel. The tab has eight circular openings 12 0.188 inch (0.476 cm.) in diameter regularly spaced about its perimeter. In the embodiments shown in the drawings, the centers of openings 12 are located one inch (2.54 cm.) from the center of the tab. The openings have been punched from the tab in a manner such that each opening has projections or lugs 13*a* and 13*b* in FIG. 2, approximately 0.188 (0.476 cm.) in height communicating therewith and extending from the bottom surface of the tab. Projection 13*a* is spaced from projection 13*b* so that fluid asphalt flowing into an opening 12 is thus allowed to continue to spread past the projections and beneath the tab as will be more fully described later.

In FIG. 5 the tab of FIG. 1 is shown in use according to the invention positioned beneath the head of a fastener of the type described in U.S. Pat. Nos. 3,710,672 and 4,031,802 to Hallock, the disclosures of which are hereby incorporated by reference. The Hallock nail shown is the preferred nail for use according to the invention although it will be obvious that the tab 10 can be used in conjunction with other nails used for the same purpose in the art. The Hallock nail is shown in more detail in FIGS. 3 and 4.

The nail shown in FIG. 3 is a one piece construction integrally formed from a single metal blank (e.g. see FIG. 9 of U.S. Pat. No. 3,710,672). The nail is generally comprised of a generally flat head portion 14 and a hollow tubular shank portion 15 depending fron the head portion. The head has an embossment 16 best shown in FIGS. 4 and 5 to strengthen it against flexing.

The shank 15 of the nail is made up of two opposed "U" or channel-shaped legs 17 and 18 the sides of which overlap to form a hollow rectangular tube. Each of the legs 17 and 18 is formed integrally with the head 14 and are hinged thereto by way of flaps 19 and 20 respectively. Each of the flaps is attached to the head 14 by "knock-out" portions 21 punched from the head and part of each of the flaps. The head 14 of the nail has a diameter of approximately 1.19 inch (3.02 cm.) and the length of the legs 17 and 18 is approximately 1.63 inches (4.13 cm.).

The legs 17 and 18 are caused to spread apart upon insertion into the soft insulating concrete by sloping the interior surfaces of opposed sides 22 and 23 of legs 17 and 18, respectively, toward one another. The portion of soft concrete entrapped within the hollow enclosure of the legs as the nail is driven pushes against these sloped surfaces forcing them apart. The entrapped material resists against subsequent withdrawal of the fastener. The use of such overlapping channel-shaped legs as a shank, the width of which is the same at the bottom as at the top has the advantage over for example a cone-shaped shank such as shown in U.S. Pat. No. 3,466,967 that no void in the soft cement is left at the point of insertion following penetration of the shank.

In FIG. 6, the shank of the nail of FIG. 3 has been inserted through center hole 11 of tab 10 and the nail driven through base ply 24 positioned upon a layer 25 of insulating concrete, e.g. a mixture of Portland cement, expanded vermiculite, air-entraining agent and water. Legs 17 and 18 have spread to better lock the nail within the concrete layer. The inserted nail-tab combination shown in FIG. 6 is ready for the usual layer of hot fluid asphalt applied, e.g. by mopping, over the entire upper surface of the nail, tab and base ply. Openings 12 in combination with the stand-off projections 13*a* and 13*b* permit the asphalt to flow between the tab 10 and base ply 24. The tab is lifted from the base ply surface by the projections 13*a* and 13*b* which both allows the asphalt to be mopped under the edge of the tab and also to pass from openings 12 to the underside of tab 10. The result is a bonding of the lower surface of the tab to the base ply as well as a bonding of the upper plies of built-up roofing applied over the hot fluid asphalt to the base ply underlayer by way of the openings 12.

Various alternative constructions for tab 10 are shown in FIGS. 7 through 13. In FIGS. 7 and 8, the tab 10 has generally straight non-interconnecting embossments 26*a* and 26*b* approximately 0.13 inch (0.32 cm.) wide in its surface communicating both with openings 12 and the outer edge 27 of the tab. The embossments 26*a* and 26*b* raise from the surface of the tab e.g. about 0.063 inch (0.19 cm.). The embossments may be raised from the upper surface of the tab (26*b*) in which case they create channels between the tab and the base ply which serve to conduct and distribute fluid asphalt. The embossments may also raise from the lower surface (26*b*) in which case they act as "stand-offs" to raise the tab from the surface of the base ply. Preferably the tab 10 of FIG. 7 has both a number of embossments 26*b* which raise from its upper surface and a number of embossments 26*a* which raise from its lower surface. Such embossments 26*a* and 26*b* can be alternatively staggered with respect to one another around the circumference of the tab as shown.

The embossment in the surface of tab 10 may also be in the form of one or more continuous circumferential channels, such as shown in FIGS. 9 and 10, which interconnect all of openings 12, and which may be raised from either or both surfaces of the tab. In FIG. 9, outermost circumferential embossment or channel 28*a* is raised from the upper surface of the tab, while the inner embossment or channel 28*b* is raised from the lower surface. Openings 12 are located such that they communicate with both channels 28*a* and 28*b*.

An especially preferred construction for tab 10 is shown in FIG. 11. The tab shown therein is essentially a combination of the tabs shown in FIGS. 7 and 9. The tab of FIG. 11 has a number of embossments 26*a* from its lower surface equal to the number of embossments 26*b* from its upper surface and such are alternatively staggered with respect to one another about the perimeter of the tab. The preferred tab of FIG. 11 additionally has the continuous, adjacent circumferential embossments 28a and 28b of the tab of FIG. 9 raised from its upper and lower surfaces respectively. Each opening 12 in the tab of FIG. 11 communicates with both embossments 28a and 28b, as well as a linear embossment 26a and 26b. The result is a "fool proof" tab, that is one which can be used with a nail as in FIGS. 5 and 6 with either its upper or lower surface adjacent the base ply with excellent distribution of fluid asphalt between the base ply and the lower surface of the tab resulting in either case.

Another "fool-proof" tab construction according to the invention is shown in FIGS. 12 and 13. In this case, the tab surfaces are corrugated, the corrugations 29 serving to admit and conduct the fluid asphalt mopped around the fastener. Although not shown in FIGS. 12 and 13, the tab 10 is preferably fashioned with the openings 12 of the previous Figures since bonding of the base ply underlying the tab of FIGS. 12 and 13 would be dependent solely upon asphalt being mopped under the edge of the tab.

It is obvious to one skilled in the art that tab 10 and openings 11 and 12 can have a geometry other than circular as has been shown by way of illustration only in the drawings. For example, tab 10 can have an overall square or rectangular configuration as can openings 11 and 12. Also the undulations or embossments in the surfaces of the tabs can be made interconnecting or non-interconnecting in any desired fashion. Moreover the tab can be used in connection with any of the various nails or fasteners conventionally used to attach roofing membranes in the art other than that shown in the drawings, and also in connection with cementitious materials other than vermiculite/Portland cement mixes for example, mixes containing gypsum or other hydratable binders with or without lightweight aggregates or foaming agents.

It is also obvious that the fastener of the invention can have dimensions other than those given above. For securing base plys of built-up roofing membranes in the manner of the invention however, it is desirable that the tab 10 have a width of at least 1.75 inches (4.5 cm.), preferably at least about 2 inches (5.08 cm.), and that the width of openings 12 be at least about 0.06 inch (0.15 cm.), preferably at least about 0.12 inch (0.30 cm.).

It is claimed:

1. The combination of roofing material for waterproofing a roofing deck and a holder for securing said roofing material to the deck, comprising said roofing material including at least one layer of resilient sheet material engaging said deck and a layer of waterproof adhesive covering said resilient sheet material, said adhesive being flowable when it is applied and substantially non-flowable after it sets, said holder including a generally flat body having upper and lower surfaces and an outer edge, means for penetrating said resilient sheet material and attaching said holder to the deck with a substantial portion of said lower surface engaging said sheet material, said holder having a plurality of raised portions extending generally radially inwardly from said outer edge, each of said raised portions having an upper convex surface and a lower concave surface in which said convex surfaces extend above said upper surface of said body and said concave surfaces define hollow spaces below said raised portions which extend to said outer edge and permit flowable adhesive to flow thereinto, and said holder having a plurality of apertures extending through said raised portions and communicating with said hollow spaces to permit flowable adhesive to flow into the hollow spaces and form enlarged plugs, whereby said resilient sheet material is attached to the deck by said holder and said pentrating means and thereafter flowable adhesive is applied to said resilient sheet material and said upper surface of said holder and said adhesive flows into the outer ends of said hollow spaces and through the openings to form enlarged plugs in the hollow spaces which are integrally connected to the adhesive above said holder when said adhesive sets.

2. An improved fastener for attaching a base ply of a multi-ply built-up roofing membrane to a soft not fully cured cementitious construction material and over which ply fluid asphalt is to be applied after installation, said fastener being comprised of (a) a centrally located nailing element positioned within (b) a separate base ply bonding element non-integral with said nailing element, said central nailing element having a generally flat planar head serving as a washer to hold said base ply down and a narrower hollow penetrating shank depending from the lower planar surface of said head, said shank being comprised of a pair of overlapping, channel-shaped legs and being adapted to expand during insertion into said construction material to thereby capture said construction material within it and lock the nailing element in the construction material; said base ply bonding element being in the form of a generally flat tab having broad upper and lower opposed planar surfaces, narrow terminal end surfaces and a central opening penetrated by said shank, said central opening being narrower than said nailing element head in order that at least a portion of said lower surface of said head bears on the said upper planar surface of said tab, said tab being wider in crosswise dimension than said nailing element head so that a portion of said tab extends beyond said head, said tab having a plurality of additional openings therethrough distributed around its portion extending beyond said head which openings extend from said upper planar surface to said lower planar surface, said tab further having at least one embossment raised from at least one of its said planar surfaces communicating between at least one of said additional openings and a said terminal end surface of said tab, said embossment acting as an asphalt-conducting channel, whereby fluid asphalt applied over said fastener and said base ply is permitted to fill said additional openings and also to flow between said tab and said base ply in order to bond the portion of the base ply beneath said tab and increase the resistance of the roofing membrane to uplifting by wind.

3. The fastener of claim 2 having a plurality of said embossments, certain of said embossments raising from a said planar surface of said tab, other of said embossments raising from the opposed planar surface of said tab.

4. The fastener of claim 2 wherein said tab has a width of at least about 1.75 inches.

5. The fastener of claim 2 wherein said tab has a width of at least about two inches.

6. The fastener of claim 2 wherein said additional openings through said tab have a width of at least about 0.12 inch.

7. The fastener of claim 2 wherein said embossment is raised from the said planar surface of said tab upon which said nailing element head bears.

8. The fastener of claim 2 wherein said embossment is raised from the said planar surface of said tab adjacent said base ply.

* * * * *